US005481981A

United States Patent [19]

Sippel et al.

[11] Patent Number: 5,481,981

[45] Date of Patent: Jan. 9, 1996

[54] SABOT FOR A SUBCALIBER PROJECTILE

[75] Inventors: Achim Sippel, Rotenburg/Fulda; Thomas Heitmann, Düsseldorf; Willhelm Becker, Willich; Klaus Unterstein, Düsseldorf; Jürgen Leeker, Neuss; Walter Simon, Herzogenrath, all of Germany

[73] Assignee: Rheinmetall GmbH, Ratingen, Germany

[21] Appl. No.: 303,027

[22] Filed: Sep. 8, 1994

[30] Foreign Application Priority Data

Sep. 8, 1993 [DE] Germany ..... 43 30 417.6

[51] Int. Cl.[6] ..... F42B 14/06

[52] U.S. Cl. ..... 102/522; 102/523

[58] Field of Search ..... 102/520–523

[56] References Cited

U.S. PATENT DOCUMENTS

| | | | |
|---|---|---|---|
| 2,382,152 | 8/1945 | Jakobsson | 102/93 |
| 2,788,744 | 4/1957 | Donner | 102/523 |
| 4,296,687 | 10/1981 | Garrett | 102/518 |
| 4,850,280 | 7/1989 | Wallow et al. | 102/522 |
| 4,964,342 | 10/1990 | Schleicher | 102/521 |
| 5,012,744 | 5/1991 | Sowash | 102/523 |
| 5,052,305 | 10/1991 | Chiarelli et al. | 102/522 |

FOREIGN PATENT DOCUMENTS

| | | | |
|---|---|---|---|
| 0264546 | 4/1988 | European Pat. Off. . | |
| 0376082 | 7/1990 | European Pat. Off. . | |
| 3318972A1 | 12/1983 | Germany . | |
| 3704027 | 8/1988 | Germany | 102/521 |
| 305152 | 2/1955 | Switzerland . | |
| 1321264 | 6/1973 | United Kingdom . | |
| 2003261 | 3/1979 | United Kingdom . | |
| WO87/05386 | 9/1987 | WIPO . | |
| WO91/13313 | 9/1991 | WIPO . | |
| WO93/02333 | 2/1993 | WIPO . | |

*Primary Examiner*—Harold J. Tudor
*Attorney, Agent, or Firm*—Spencer, Frank & Schneider

[57] ABSTRACT

A sabot for a subcaliber projectile, preferably an arrow projectile, having an essentially cylindrical guide gage (8) of a lightweight material and a tail-side drive element (14) detachably connected thereto for tail-side support of the projectile body (1). The guide cage (8) has a radially inwardly-extending support wall (12) for supporting a projectile body (1) disposed therein in its forward to central region, and the drive element is a propelling disk (14) that is received by a circumferential or annular groove (13) in the tail region of the guide cage (8), which is segmented in the axial direction of the projectile body (1). As a result, a further reduction in weight can be accomplished with simpler fragmenting of the sabot that practically does not impair the projectile at all.

20 Claims, 1 Drawing Sheet

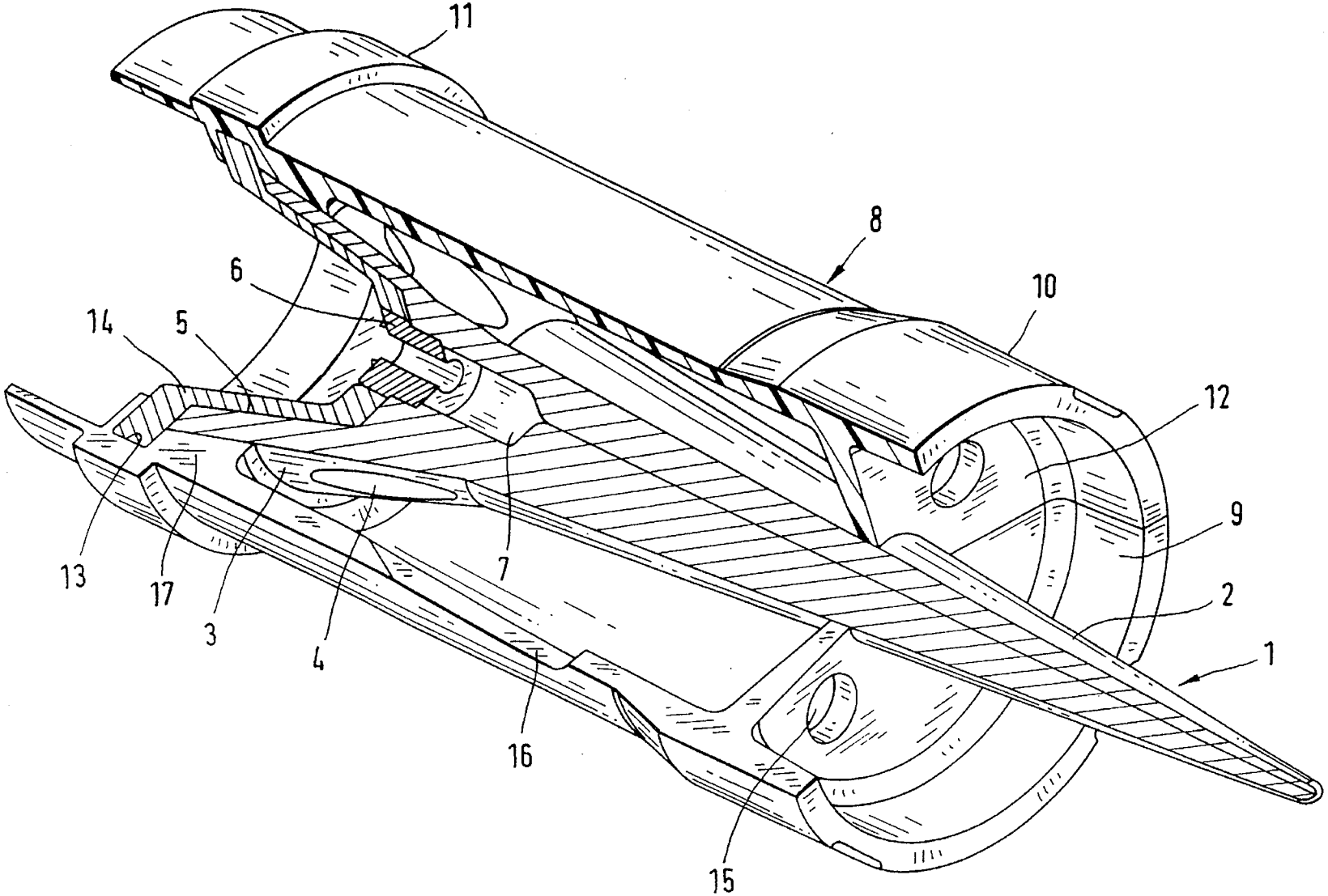
1
2
9
12
10
8
11
6
5
14
13
17
3
4
7
16
15

SABOT FOR A SUBCALIBER PROJECTILE

BACKGROUND OF THE INVENTION

The invention relates to a sabot for a subcaliber projectile, preferably an arrow projectile, of the type having an essentially cylindrical side walled guide cage of a lightweight material, and a tail-side drive element detachably connected to the guide cage for tail-side or end support of the projectile body, and wherein the guide cage has a radially inwardly-extending support wall for supporting the projectile body in the forward to central region of the side wall.

A sabot for a subcaliber, spin-stabilized projectile that includes an essentially cylindrical and one-piece guide cage provided with predetermined fracture points is known from German laid open Patent Application No. DE 33 18 972 A1. The guide cage has a forward, radial support wall that has an opening for holding the conical projectile tip, while a cupular drive element is screwed into the guide cage, extends over nearly half the length of the guide cage, and supports the projectile on the tail side. A corresponding weight reduction is the objective of using glass fiber-reinforced polyamide for the guide cage and aluminum for the drive element. However, despite these measures, the drive element takes on a considerable volume and therefore possesses a corresponding weight which requires a corresponding quantity of propellant. Moreover, the fragmentation of the sabot requires the bursting of the guide cage along the predetermined fracture points, by means of which the uniformity of the detachment and thus the dispersion pattern can be impaired.

It is the object of the invention to create a sabot for a subcaliber projectile of the type first mentioned above wherein the sabot is further reduced in weight, which has a positive influence on the dispersion pattern.

SUMMARY OF THE INVENTION

The above object is achieved according to the present invention by a sabot for a subcaliber projectile, preferably an arrow projectile, which comprises: a guide cage having an essentially cylindrical side wall and which is segmented in its longitudinal axial direction and is formed of a lightweight material, with the side wall having a radially inwardly-extending support wall, for supporting a projectile body, in its forward to central region and a circumferential or annular groove in an inner surface in its tail region; and, a drive element detachably connected to the guide cage in its tail region for tail-side support of a projectile body, with the drive element being a propelling disk that is received by and supported in the circumferential or annular groove of the guide cage.

Further embodiments and features of the invention are to be taken from the description below wherein the invention is described in detail in conjunction with an embodiment illustrated in the attached drawing FIGURE.

BRIEF DESCRIPTION OF THE DRAWINGS

The FIGURE is a perspective view partly cut open, of a preferred embodiment of an arrow projectile and its sabot according to the invention.

DETAILED DESCRIPTION OF THE PREFERRED EMBODIMENT

The arrow projectile according to the illustrated embodiment, which is conceptualized as a training projectile with a shortened range, includes a projectile body 1, which has a longitudinally-extending, conical tip 2 whose base corresponds to the caliber of the projectile body 1, and a conical tail part 3 which is directly connected to the tip 2 and provides resistance or drag stabilization. This tail part 3 has an enlarged caliber and thus has a larger cone angle than the conical tip 2.

The tail part 3, which is configured as a perforated cone-guide mechanism, has, in the region of enlarged caliber, bores 4 which extend in the axial direction of the arrow projectile body 1 or are slightly inclined with respect to the axial direction and, in a known manner, impart a spin to the arrow projectile. The tail part 3 is configured as a double cone, that is, it is provided on the rear side with a frustoconical recess 5. As shown, projectile body 1 can additionally have a rear-side, axial recess 7 for receiving a tracer assembly, with the recess 7 being closed by a screw 6.

The provided sabot includes a guide cage 8, which comprises two segments as shown and can be made of, for example, an aluminum alloy or especially plastic. This guide cage 8 is extensively configured as a cylinder, i.e., has a cylindrical side wall, which is very resistant to bending and buckling and has an air pocket 9 formed on the forward side or front end. Guide cage 8 has a forward and a rear band region 10 or 11, respectively, for guidance or guidance and sealing of the sabot within the weapon barrel. In the forward band region 10, each half of guide cage 8 is provided with a radially inwardly directed support wall 12 which is axially displaced from the forward end of the cylindrical side wall of the guide cage 8 and which defines air pocket 9 toward the inside, i.e., the base of the air pocket 9. Each support wall 12 additionally encompasses and holds projectile body 1 in the forward region of the sabot. Furthermore, each half of guide cage 8 is provided on its inner surface in the rear region 11 with a circumferential or annular groove 13, which has a rectangular cross-section and receives a propelling disk 14, made of, for example, steel. This disk 14 is configured to be frustoconical and has a circumferential or annular flange which is received by groove 13. The conical angle of the disk 14 corresponds to the conical angle of recess 5 on the rear side of projectile body 1, so that the latter is completely (up to the region of screw 6) in contact with the propelling disk 14.

Guide cage 8 and projectile body 1 with propelling disk 14 experience the same acceleration during launch, so no differential forces occur between guide cage 8 and projectile body 1. Guide cage 8 must therefore support only itself, and for this reason can be made of plastic in particular. The guide band or sealing band 10, 11 can be directly integrated into the plastic guide cage 8 as shown, i.e. injection-molded along with the guide cage.

Axial bores 15 are cut into support wall 12. As the projectile passes through the weapon barrel, the interior of guide cage 8 is acted upon by the dynamic pressure in the weapon barrel. Because of the delayed expansion of the gas cushion preserved in this way, after exit of the guide cage and from the weapon barrel a parallel detachment movement of the two halves or segments of guide cage 8 is initiated.

Flow-through holes 16 for gas leakage and weight decrease can be provided laterally in the cage side wall in the region of the separating plane of the segments of the guide cage 8. The side wall thickness of guide cage 8 advisably increases gradually toward the tail as shown.

In the tail region, the segments of guide cage 8 have an inwardly-oriented projection 17 that is in circumferential contact with the tail-side segment of tail part 3 of projectile body 1. Projection 17 is embodied to be integral with the segments of guide cage 8. In addition, as shown, projection 17 forms the front-side wall of groove 13.

Instead of the illustrated projectile body 1, the sabot can also receive a projectile body that has a cylindrical segment between conical tip part 2 and tail part 3, and/or is provided with a different tail guidance mechanism, for example, a guide mechanism for fins, slotted cones, double cones or the like.

The segments of guide cage 8 can be formed as injection-molded parts of plastic or aluminum.

The lower projectile weight effected by the sabot according to the invention permits the reduction of the quantity of propellant necessary for propulsion. In addition, the manufacturing and assembly expenditure is decreased, as is the negative influence of detachment of the sabot from the subcaliber projectile body 1, because of which the pattern dispersion is improved accordingly.

The invention now being fully described, it will be apparent to one of ordinary skill in the art that any changes and modifications can be made thereto without departing from the spirit or scope of the invention as set forth herein.

What is claimed:

1. A sabot for a subcaliber projectile comprising:

a guide cage having an essentially cylindrical side wall and which is segmented in its longitudinal axial direction, said side wall having a radially inwardly-extending support wall, for supporting a projectile body, in its forward to central region, and having an annular groove in an inner surface in its tail region, said support wall being provided with axial bores; and, a drive element detachably connected to said guide cage in said tail region for tail-side support of a projectile body, said drive element being a propelling disk that is received by and supported in said annular groove of said guide cage.

2. A sabot as defined in claim 1, wherein an air pocket is disposed in front of said support wall within said guide cage.

3. A sabot as defined in claim 1, said side wall of said guide cage has a thickness which increases progressively toward its tail region.

4. A sabot as defined in claim 1, wherein said guide cage has two segments.

5. A sabot as defined in claim 1, wherein said propelling disk has an essentially frustoconical shape, which corresponds to a tail-side conically tapered recess of a projectile body with which the disk comes into contact, and has a circumferential flange which is received by said annular groove of said guide cage.

6. A sabot as defined in claim 1, wherein said side wall of said guide cage has lateral openings.

7. A sabot as defined in claim 1, wherein respective segments of said guide cage have inwardly-oriented projections on said inner wall in said tail region, which projections are integral with the respective said segments and are brought into contact with a circumferential surface of a projectile body.

8. A sabot as defined in claim 1, wherein said support wall is axially displaced from a front end of said side wall to define an air pocket in the front region of said guide cage.

9. A sabot as defined in claim 8 wherein said side wall has lateral openings.

10. A sabot as defined in claim 9, wherein said guide cage has two segments.

11. A sabot as defined in claim 10, wherein said propelling disk has an essentially frustoconical shape, which corresponds to a tail-side conically tapered recess of a projectile body with which the disk comes into contact, and has a circumferential flange which is received by said annular groove of said guide cage.

12. A sabot as defined in claim 11, wherein respective segments of said guide cage have inwardly-oriented projections on said inner wall in said tail region, which projections are integral with the respective said segments and are brought into contact with a projectile body.

13. A sabot as defined in claim 1, wherein said guide cage is formed of a plastic material and said propelling disk is formed of steel.

14. In combination with an arrow projectile, a sabot comprising:

a guide cage having an essentially cylindrical side wall and which is segmented in its longitudinal axial direction and a longitudinal axial direction of the projectile, said side wall having a radially inwardly-extending support wall, which is provided with axial bores, in its forward to central region for supporting a body of said projectile, and an annular groove in an inner surface in its tail region; and, a drive element detachably connected to said guide cage in said tail region for tail-side support of said projectile body, said drive element being a propelling disk that is received by and supported in said annular groove of said guide cage.

15. The projectile and sabot combination as defined in claim 14, wherein: said projectile body has an essentially frustoconically shaped recess in its rear end; said propelling disk has a portion with an essentially frustoconical shape corresponding to that of said frustoconical recess in said projectile body, and a radially extending circumferential flange which is received by said annular groove in said side wall of said guide cage; and, said portion of said disk with said frustoconical shape extends into said recess in said projectile body and into contact with said projectile body.

16. The projectile and sabot combination as defined in claim 15, wherein said support wall is axially displaced from a front end of said side wall to define an air pocket in the front region of said guide cage.

17. The projectile and sabot combination as defined in claim 16, wherein respective segments of said guide cage have inwardly-oriented shaped projections on said inner wall in said tail region, with said projections being integral with the respective said segments and contacting said projectile body.

18. The projectile and sabot combination as defined in claim 17, wherein said side wall has lateral openings, and said guide cage is segmented into two segments.

19. The projectile and sabot combination as defined in claim 14, wherein said guide cage is formed of one of aluminum and a plastic material, and said propelling disk is formed of steel.

20. The projectile and sabot combination as defined in claim 19, wherein said guide cage is formed of a plastic material.

* * * * *